US010792222B2

(12) United States Patent
Palmi et al.

(10) Patent No.: US 10,792,222 B2
(45) Date of Patent: Oct. 6, 2020

(54) PILL CRUSHER AND CORRESPONDING METHODS

(71) Applicant: Medline Industries, Inc., Northfield, IL (US)

(72) Inventors: Jason Palmi, Elgin, IL (US); Tim Happel, Mundelein, IL (US); Curtis Schmitz, Kenosha, WI (US)

(73) Assignee: Medline Industries, Inc., Northfield, IL (US)

( * ) Notice: Subject to any disclaimer, the term of this patent is extended or adjusted under 35 U.S.C. 154(b) by 479 days.

(21) Appl. No.: 15/623,083

(22) Filed: Jun. 14, 2017

(65) Prior Publication Data

US 2018/0360691 A1 Dec. 20, 2018

(51) Int. Cl.
*A61J 7/00* (2006.01)

(52) U.S. Cl.
CPC ..... *A61J 7/0007* (2013.01)

(58) Field of Classification Search
CPC ..... A61J 7/0007; A61J 7/0015
USPC ..... 241/30
See application file for complete search history.

(56) References Cited

U.S. PATENT DOCUMENTS 2,526,273 A * 10/1950 Cuthbert ..... A47J 43/26 30/120.5
2,655,259 A * 10/1953 Davoren ..... A61J 7/0007 225/43
2,870,967 A * 1/1959 Huelden ..... A47J 43/04 241/222
3,713,468 A * 1/1973 Walsh ..... A47J 43/26 99/580
3,915,393 A * 10/1975 Elkins ..... A61J 7/0007 241/168
4,009,651 A * 3/1977 Adams ..... A47J 43/26 99/579
4,077,121 A * 3/1978 Waller ..... A47J 43/26 30/120.3
4,173,826 A * 11/1979 Leopoldi ..... A61J 7/0007 225/103
4,197,647 A * 4/1980 Goldenthal ..... A61C 3/16 433/159
4,199,863 A * 4/1980 Deckert ..... A61J 7/0007 30/124

(Continued)

OTHER PUBLICATIONS

Malley, Mary , "NonFinal Office Action", U.S. Appl. No. 29/607,600, filed Jun. 14, 2017; dated May 2, 2019.

*Primary Examiner* — Sean M Michalski
(74) *Attorney, Agent, or Firm* — Philip H. Burrus, IV

(57) ABSTRACT

A crushing device (100) includes a base (101). A first sidewall (103) and a second sidewall (104) extend distally from the base. A crushing assembly (102) is coupled between the first sidewall and the second sidewall. The crushing assembly can include a first crushing plate (601) pivotally coupled about a first pivot (406) defining a first axis (111) and a second crushing plate (602) pivotally coupled about a second pivot (507) defining a second axis (112). A lever (110) is coupled to the first crushing plate, and is selectively movable between a first position (600) and a second position (700) to rotate the first crushing plate in a first radial direction (703). A cog insert (604), coupled between the first crushing plate and the second crushing plate, causes the second crushing plate to rotate in a second radial direction (704), opposite the first radial direction.

10 Claims, 9 Drawing Sheets

(56) References Cited

U.S. PATENT DOCUMENTS 4,255,855 A * 3/1981 Brazil ..... A47J 43/26 30/120.2
4,536,958 A * 8/1985 Tosi ..... A47J 43/26 30/120.3
4,554,736 A * 11/1985 Rodriguez ..... A47J 43/26 30/120.3
4,554,737 A * 11/1985 Bartels ..... A47J 43/26 30/120.3
4,603,624 A * 8/1986 Greenblatt ..... A47J 43/26 99/572
D285,966 S 9/1986 Porter
4,612,854 A * 9/1986 Chiro ..... A47J 43/26 100/233
5,025,996 A * 6/1991 Lavin ..... A61J 7/0007 241/168
5,038,475 A * 8/1991 Wolff ..... A61J 7/0007 225/103
5,118,021 A * 6/1992 Fiocchi ..... A61J 7/0007 225/103
5,148,995 A * 9/1992 Hurst ..... A61J 7/0007 241/169.1
5,169,076 A * 12/1992 Dols ..... A47J 43/26 241/169
5,178,337 A * 1/1993 Lupoli ..... A61J 7/0007 241/169
5,233,747 A * 8/1993 Johnson ..... A47J 43/26 30/120.1
D342,870 S 1/1994 LeClair
5,863,001 A * 1/1999 Schulze ..... A61J 7/0007 241/169
D405,889 S 2/1999 Parsons
5,915,637 A * 6/1999 Parsons ..... A61J 7/0007 241/168
6,059,209 A * 5/2000 Barson ..... A61J 7/0007 241/168
D453,044 S 1/2002 Buckley et al.
6,527,155 B2 * 3/2003 Buckley ..... A61J 7/0007 225/1
6,637,685 B1 * 10/2003 Kruger ..... A61J 7/0007 241/169.1
D535,161 S 1/2007 So
7,407,124 B1 * 8/2008 Layshon ..... A61J 7/0007 241/268
7,413,137 B2 * 8/2008 Donovan ..... A61J 7/0007 241/168
D578,839 S 10/2008 McGuyer et al.
7,445,172 B1 * 11/2008 Bucknor ..... A61J 7/0007 241/169
D626,385 S * 11/2010 Mixdorf ..... D7/680
7,845,588 B1 * 12/2010 Goodick ..... A61J 7/0007 241/169
8,376,256 B1 * 2/2013 Ferguson ..... B02C 1/00 241/169.2
8,720,808 B2 * 5/2014 Young ..... B02C 19/08 241/168
D713,540 S 9/2014 Petrie et al.
D809,153 S 1/2018 Noble
9,925,542 B2 * 3/2018 Dow ..... A61J 7/0007
D834,898 S 12/2018 Audet et al.
2004/0251357 A1 * 12/2004 Lenzkes ..... A47J 43/26 241/262
2005/0067452 A1 * 3/2005 Darst ..... A61J 7/0007 225/103
2005/0133645 A1 * 6/2005 Janzen ..... A61J 7/0007 241/169
2007/0164141 A1 * 7/2007 Engel ..... A61J 7/0007 241/169.2
2008/0061175 A1 * 3/2008 Engel ..... A61J 7/0007 241/168
2012/0187229 A1 * 7/2012 Clouser ..... A61J 7/0007 241/30
2014/0306048 A1 * 10/2014 He ..... A61J 7/0007 241/169.2
2018/0133107 A1 5/2018 Yang
2018/0360691 A1 12/2018 Palmi et al.
2019/0105231 A1 * 4/2019 Doretti ..... A61J 7/0007

* cited by examiner

PILL CRUSHER AND CORRESPONDING METHODS

BACKGROUND

Technical Field

This disclosure relates generally to mechanical devices, and more particularly to mechanical crushing devices.

Background Art

Medicines, vitamins, supplements, and other similar compressed ingestible items are frequently sold in the form of pills or solid tablets. It is sometimes the case a person is unable to ingest the tablet or pill in its original form. For example, some people simply recoil at the thought of swallowing a solid object. Others might be leery of the pill possibly "sticking" in the throat while being swallowed. In other cases, a pill or tablet may simply be tool large for a person to comfortably swallow. Some types of users, such as children or geriatric users, may simply have difficulty swallowing a pill or tablet regardless of size.

It would be advantageous to have an improved apparatus that could be used to crush pills or tablets into particulate or powder form to allow the crushed pill or tablet to be mixed with a food or liquid for easier ingestion.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
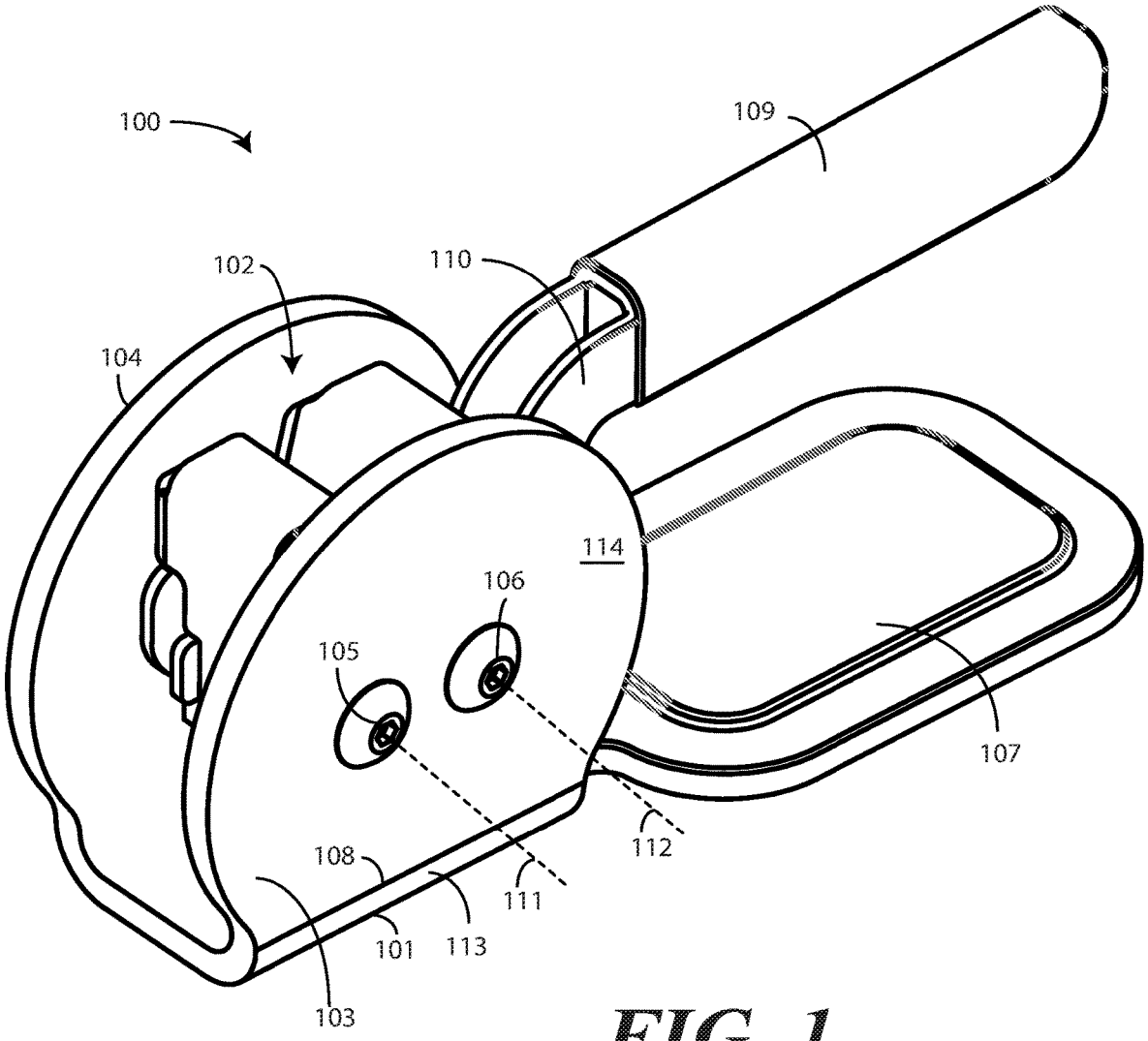
FIG. 1 illustrates a perspective view of a pill crusher in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Before describing in detail embodiments that are in accordance with the present invention, it should be observed that the embodiments reside primarily in combinations of method steps and apparatus components related to crushing pills, tablets, or other solid objects. Alternate implementations are included, and it will be clear that functions may be executed out of order from that shown or discussed, including substantially concurrently or in reverse order, depending on the functionality involved. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. It is expected that one of ordinary skill, notwithstanding possibly significant effort and many design choices motivated by, for example, available time, current technology, and economic considerations, when guided by the concepts and principles disclosed herein will be readily capable of constructing pill crushers in accordance with embodiments of the disclosure with minimal experimentation.

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

As used herein, components may be "operatively coupled" when information can be sent between such components, even though there may be one or more intermediate or intervening components between, or along the connection path. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Referring to FIGS. 1-6, illustrated therein is a crushing device 100 configured in accordance with one or more embodiments of the disclosure. The crushing device 100 is suitable for crushing pills, tablets, and other similar objects. More specifically, in one or more embodiments pills, tablets, or other small objects can be placed into a pouch. The pouch can then be inserted into a crushing assembly 102 of the crushing device 100 for crushing. After crushing, the pills, tablets, or other small objects can be poured from the pouch for subsequent usage.

The crushing device 100 consists generally of a base 101 and a crushing assembly 102. A first sidewall 103 and a second sidewall 104 extend distally from the base 101. In this embodiment, the first sidewall 103 and the second sidewall 104 extend distally substantially orthogonally from the base 101 such that the first sidewall 103 and the second sidewall 104 are substantially parallel.

In this illustrative embodiment, the first sidewall 103 and the second sidewall 104 are round, with the exception of at projection defined by the intersection 108 of the base 101 and either the first sidewall 103 or the second sidewall 104. Said differently, in this illustrative embodiment the first sidewall 103 and the second sidewall 104 each define predominantly cylindrical major faces 114, in that they are cylindrical with a projection. However, it should be noted that other shapes for the major faces 114 of the first sidewall 103 and second sidewall 104 can be used as well. For example, in another embodiment the major faces 114 of the first sidewall 103 and the second sidewall 104 can be square, pentagonal, free form shapes, polygonal, symmetrical, asymmetrical, or take other shapes.

In this illustrative embodiment, the first sidewall 103, the second sidewall 104, and the crushing assembly 102 are manufactured from a rigid metal such as steel or aluminum. In other embodiments, the first sidewall 103, the second sidewall 104, and the crushing assembly 102 can be manufactured from rigid thermoplastics such as ABS, polycarbonate, or ABS-polycarbonate. Additionally, some various portions of the crushing device 100 can be manufactured from different materials. For example, the first sidewall 103 and the second sidewall 104, and perhaps the handle 109, might be manufactured from a thermoplastic material, while the crushing assembly 102 is manufactured from metal or an alloy. Other materials from which some or all of the components of the crushing device can be manufactured will be obvious to those of ordinary skill in the art having the benefit of this disclosure.

In one embodiment, the crushing assembly 102 is coupled between the first sidewall 103 and the second sidewall 104 by one or more fasteners 105, 106. In this illustrative embodiment, the crushing assembly 102 is coupled between the first sidewall 103 and the second sidewall 104 by two cylindrical fasteners, i.e., a first cylindrical fastener 405 and a second cylindrical fastener 506. Various devices can be employed as the first cylindrical fastener 405 and the second cylindrical fastener 506, including bolts, screws, compression bolts, rivets, or other coupling devices. Still other fasteners will be obvious to those of ordinary skill in the art having the benefit of this disclosure.

In one or more embodiments, each of the first cylindrical fastener 405 and the second cylindrical fastener 506 defines a pivot 406, 507 for the components of the crushing assembly 102. Illustrating by example, in this embodiment the crushing assembly 102 includes both a first crushing plate 601 and a second crushing plate 602. The first crushing plate 601 is pivotally coupled about the first pivot 406. Similarly, the second crushing plate 602 is pivotally coupled about the second pivot 507 in this embodiment.

Figure 3:
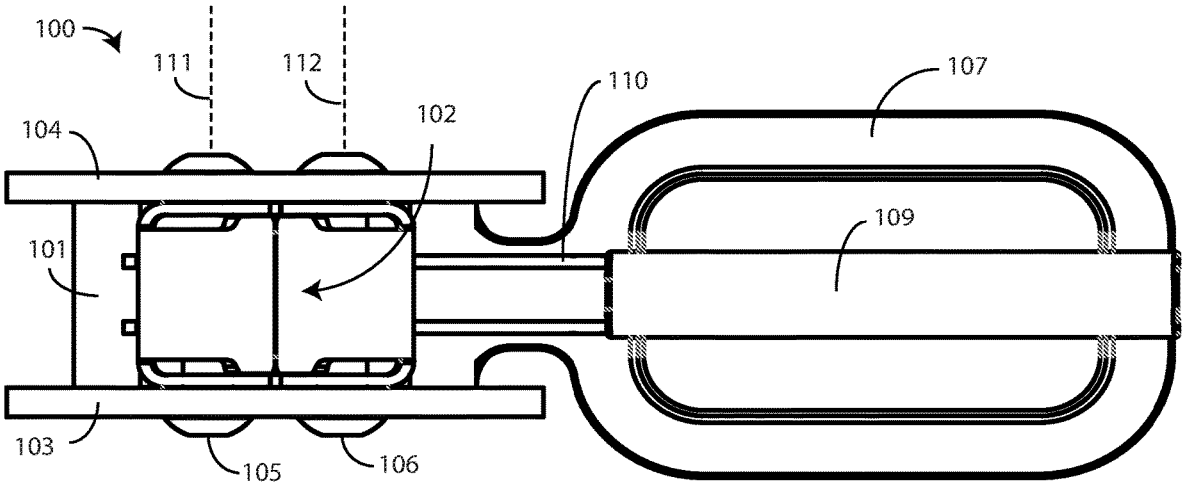
FIG. 3 illustrates a top plan view of a pill crusher in accordance with one or more embodiments of the disclosure.
Figure 4:
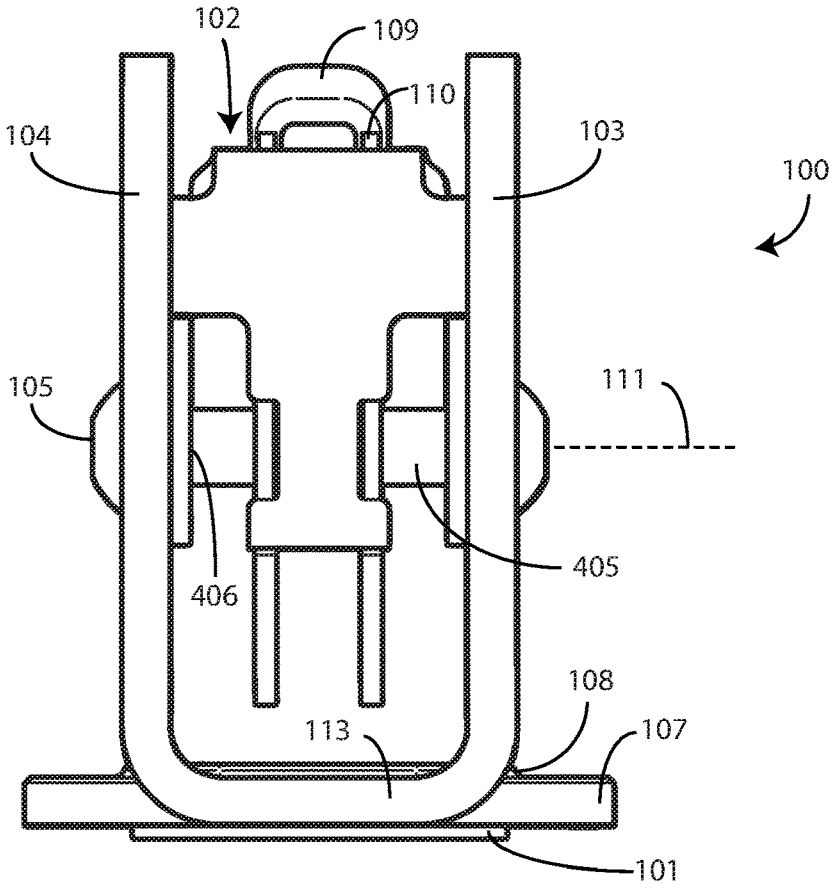
FIG. 4 illustrates a front elevation view of a pill crusher in accordance with one or more embodiments of the disclosure.
Figure 5:
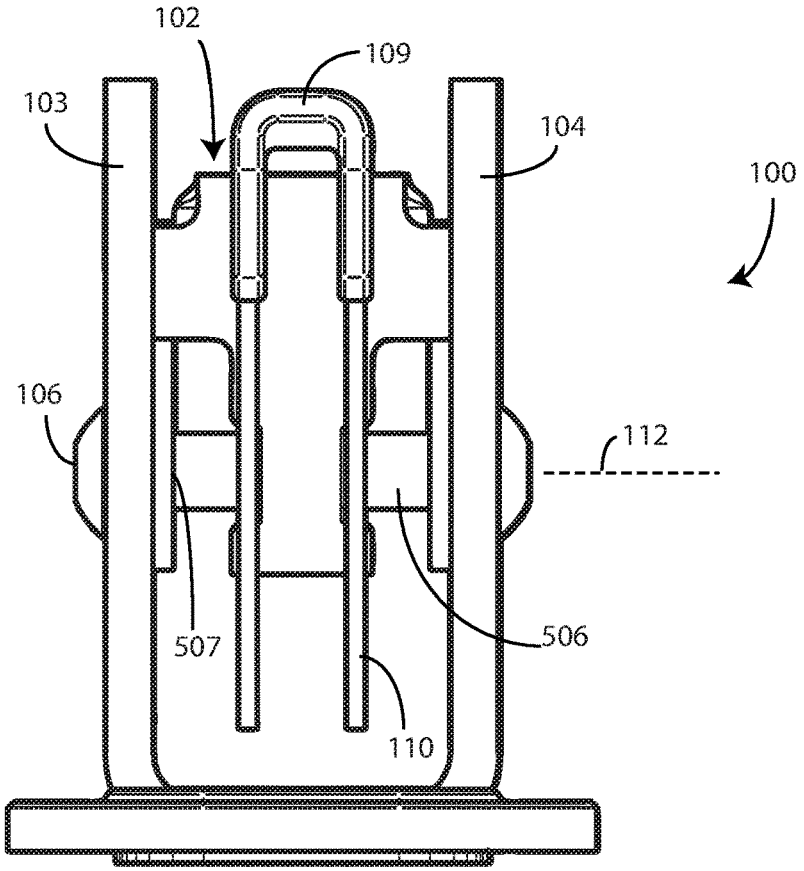
FIG. 5 illustrates a rear elevation view of a pill crusher in accordance with one or more embodiments of the disclosure.

Moreover, in one or more embodiments each of the first cylindrical fastener 405 and the second cylindrical fastener 506 defines an axis 111, 112 about which these components of the crushing assembly 102 may rotate. Thus, in this embodiment the first crushing plate 601 pivots about the first axis 111, while the second crushing plate 602 pivots about the second axis 112. As best seen in FIGS. 1 and 3, in one or more embodiments the first axis 111 and the second axis 112, defined by the first cylindrical fastener 405 and the second cylindrical fastener 506, respectively, are substantially parallel.

Figure 2:
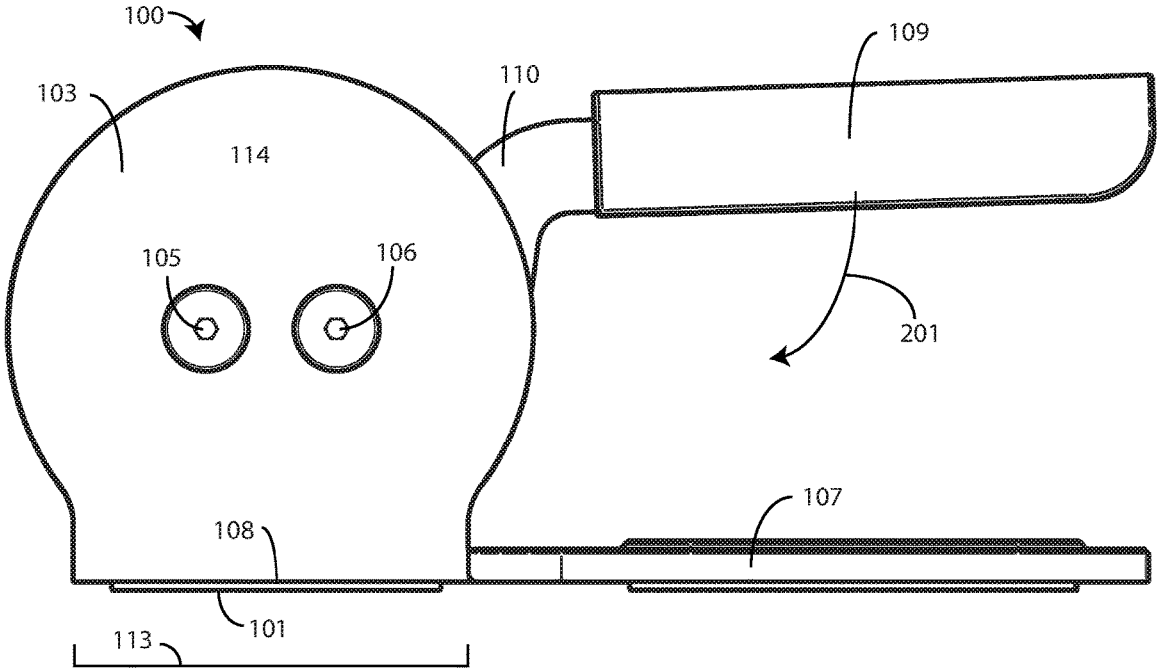
FIG. 2 illustrates a side elevation view of a pill crusher in accordance with one or more embodiments of the disclosure.

When viewed in the side elevation view of FIG. 2, each of the first sidewall 103 and the second sidewall 104 extend upwardly from a first portion 113 of the base 101 to provide mechanical support for the crushing assembly 102 when in operation. The first portion 113 of the base 101 in this embodiment is disposed beneath the intersection 108 of the base 101 and either the first sidewall 103 or the second sidewall 104.

In the illustrative embodiment shown in FIGS. 1-5, the base 101 is a "one sided" base in that it includes an extension plate 107 that extends outwardly from the first portion 113 of the base, i.e., extends distally from the intersection 108 of the base 101 and either the first sidewall 103 or the second sidewall 104, in only one direction. In this embodiment, the one direction extends outwardly from the first portion 113 of the base 101 beneath the handle 109 that is coupled to the lever 110 that actuates the crushing assembly 102. In other embodiments, the extension plate 107 can be configured to extend outwardly in two, three, four, or more directions from the intersection 108 of the base 101 and either the first sidewall 103 or the second sidewall 104 as well.

Thus, in this embodiment the lever 110 extends beyond an extent (defined by the perimeter) of the first sidewall 103 and the second sidewall 104 over the extension plate 107. As will be described in more detail below, in one or more embodiments a user operates the crushing device 100 by translating 301 the handle 109 and attached lever 110 toward the extension plate 107 to transition the lever 110 from a first position (shown in FIGS. 1-6) and a second position (shown in FIG. 7). By having the extension plate 107 disposed beneath the handle 109, the extension plate 107 provides a mechanical structure that opposes the translation 301 of the handle 109 and attached lever 110 to keep the crushing device 100 upright on a flat surface.

As noted above, in one or more embodiments, the crushing assembly 102 comprises a first crushing plate 601 and a second crushing plate 602. The lever 110 is mechanically coupled to the first crushing plate 601 in this illustrative embodiment. The lever 110 can be coupled to the handle 109. In one embodiment the lever and first crushing plate 601 are manufactured from a contiguous piece of metal, such as steel or aluminum, while the handle 109 is manufactured from a different material, such as rubber, plastic, or resin. The handle 109 can be adhesively coupled to the lever 110 in one embodiment. Alternatively, the handle 109 can be coupled to the 110 by screws or other fasteners. By manufacturing the handle 109 from a material that is different from that from which the lever 110 is manufactured, a user has a more comfortable surface upon which to apply pressure. This is in addition to the fact that the handle 109 can be manufactured in an aesthetically pleasing color and texture as well.

Figure 6:
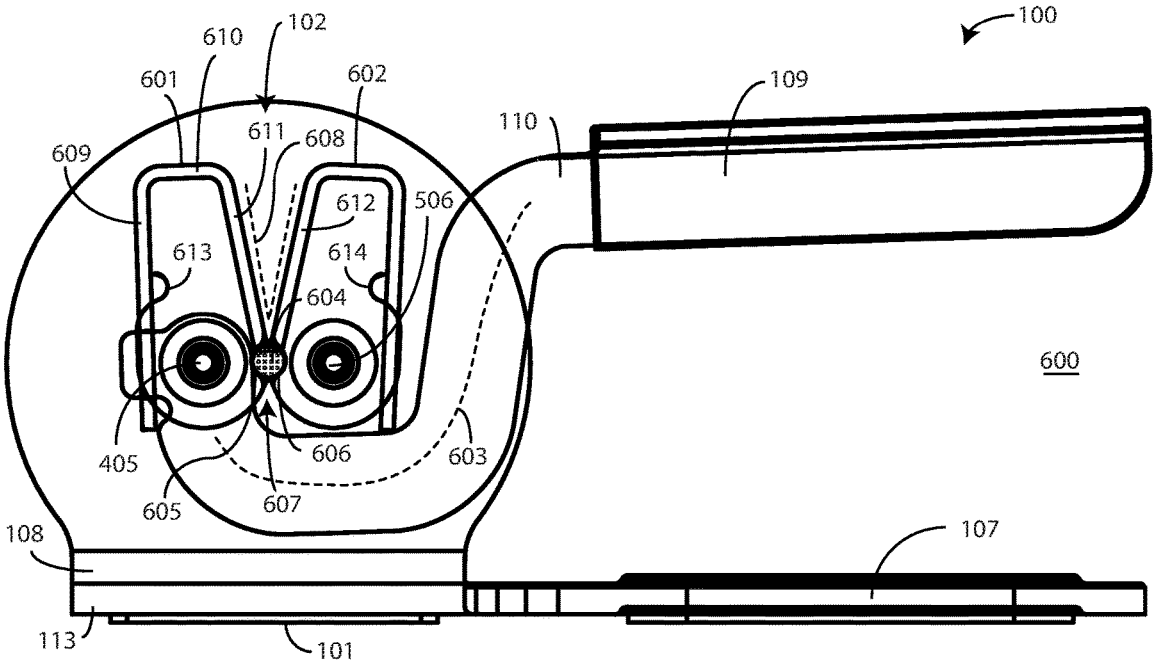
FIG. 6 illustrates a side elevation view of a pill crusher, with a sidewall shown in a transparent state to allow the internal components of the pill crusher to be seen, with the pill crusher in a first position, as well as one or more steps of using a pill crusher in accordance with one or more embodiments of the disclosure.

In one embodiment, the lever 110 defines a J-shaped interconnection 603 between the handle 109 and the first crushing plate 601. As best seen in FIG. 6, in one embodiment the second crushing plate 602 is disposed between the handle 109 and the first crushing plate 601 when the lever 110 is in a first position 600, i.e., the "default" position. This occurs because the J-shaped interconnection 603 passes from the handle 109 around the second crushing plate 602 and to the first crushing plate 601 in one embodiment. In one embodiment, the second pivot 507 is also disposed between the handle 109 and the first crushing plate 601 when the lever 110 is in the first position 600.

In this illustrative embodiment, the first crushing plate 601 and the second crushing plate 602 each comprise three surfaces. Using the first crushing plate 601 as an example, a rear surface 609, an upper surface 610, and a front surface 611 define the first crushing plate 601. The second crushing plate 602 of this illustrative embodiment is essentially a mirror image of the first crushing plate 601. In this embodiment, the upper surface 610 extends distally from an end of the rear surface 609 at a substantially orthogonal angle. The front surface 611 then extends from an end of the upper surface 610 at an obtuse angle to define a V-shape 608 with the front surface 612 of the second crushing plate 602, as will be described in more detail below.

In one embodiment, the first cylindrical fastener 405 is disposed along, and defines, the first axis 111. In one embodiment, the first cylindrical fastener 405 couples the first crushing plate 601 between the first sidewall 103 and the second sidewall 104. Accordingly, the first crushing plate 601 is pivotally coupled about the first cylindrical fastener 405 in this embodiment. Similarly, the second cylindrical fastener 506 is disposed along, and defines, the second axis 112 in one embodiment. In the illustrative embodiment of FIGS. 1-6, the second cylindrical fastener 506 couples the second crushing plate 602 between the first sidewall 103 and the second sidewall 104, such that the second crushing plate 602 is pivotally coupled about the second cylindrical fastener 506.

Figure 7:
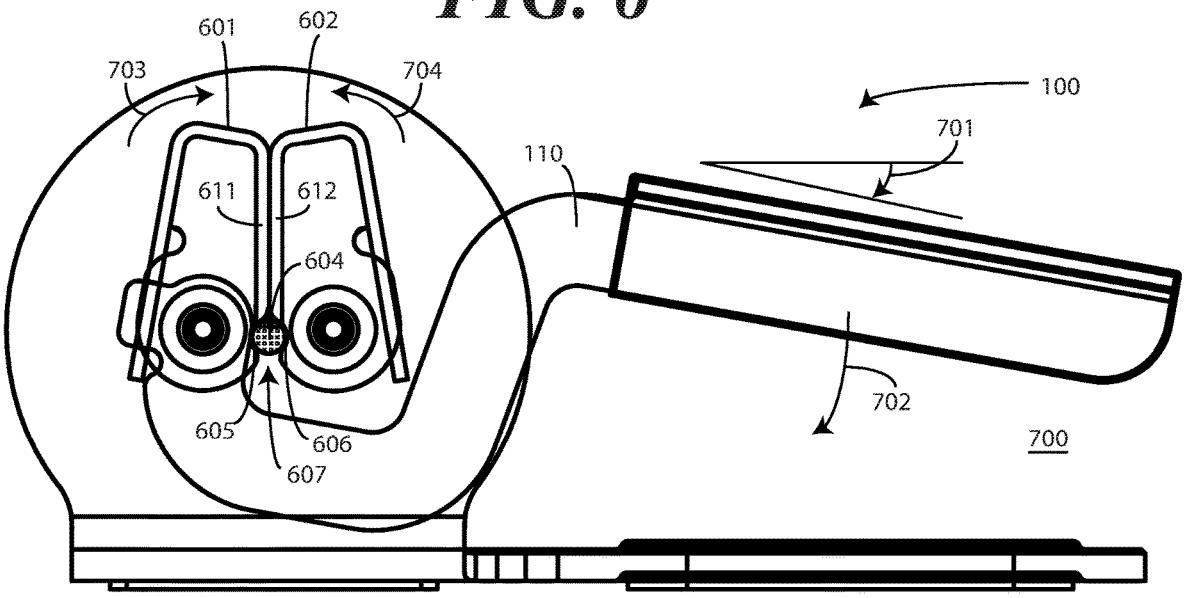
FIG. 7 illustrates a side elevation view of a pill crusher, with a sidewall shown in a transparent state to allow the internal components of the pill crusher to be seen, with the pill crusher in a second position, as well as one or more steps of using a pill crusher in accordance with one or more embodiments of the disclosure.

With reference now to FIGS. 1-7, and as noted above, in one or more embodiments, the lever 110 is selectively movable between a first position 600, which is shown in FIG. 6, and a second position 700, which is shown in FIG. 7. In this illustrative embodiment, the first position 600 is angularly displaced 701 about the first axis 111 from the first position 600. Thus, when a user rotates 702 the lever 110 about the first axis in a first direction, which is the clockwise direction as the crushing device 100 is viewed in FIG. 7, the lever 110 is angularly displaced 701 relative to the first position 600. In this embodiment, the lever 110 is angularly displaced 701 by about twenty degrees.

As shown in FIGS. 6 and 7, in this illustrative embodiment a cog insert 604 is coupled between the first crushing plate 601 and the second crushing plate 602. Each of the first crushing plate 601 and the second crushing plate 602 includes a concave recess 605, 606 at its nadir 607. Illustrating by example, in one embodiment the first crushing plate 601 defines a first concave recess 605, and the second crushing plate 602 defines a second concave recess 606. In one embodiment, the cog insert 604, which can be manufactured from a cylindrical metal or plastic rod, can then be disposed in both the first concave recess 605 and the second concave recess 606. The cog insert 604 thus is coupled between the first crushing plate 601 and the second crushing plate 602.

When the lever 110 translates 301 or rotates 702 from the first position 600 to the second position 700, this causes the first crushing plate 601 to pivot about the first cylindrical fastener 405 and the first axis 111 in a first radial direction 703. When this occurs, the cog insert 604, coupled between the first crushing plate 601 and the second crushing plate 602, causes the second crushing plate 602 to rotate about the second cylindrical fastener 506 and the second axis 112 in a second radial direction 704. In this embodiment, the first radial direction 703 is opposite the second radial direction 704.

This rotation in opposite directions of the first crushing plate 601 and the second crushing plate 602 causes the first crushing plate 601 and the second crushing plate 602 to abut when in the second position 700, as shown in FIG. 7. More specifically, the front surface 611 of the first crushing plate 601 and the front surface 612 of the second crushing plate 602 abut when the lever 110 rotates 702 to the second position 700.

By contrast, when the lever 110 is in the first position 600, the first crushing plate 601 and the second crushing plate 602 define a V-shape 608, as shown in FIG. 6. When the first crushing plate 601 and the second crushing plate 602 define the V-shape 608 in the first position 600, the cog insert 604 is disposed at a nadir 607 of the V-shape 608. In one or more embodiments, one or more springs 613, 614 can be incorporated into the crushing assembly 102 to bias the first crushing plate 601 and the second crushing plate 602 to the first position 600.

When using the crushing device 100, one may place a pill, tablet, or other article between the first crushing plate 601 and the second crushing plate 602 when the lever 110 is in the first position 600. Alternatively, one may place the pill, tablet, or other article into a pouch so that crushed matter can be more readily retrieved after the crushing operation. The pouch can then be placed between the first crushing plate 601 and the second crushing plate 602 when the lever is in the first position 600.

One then rotates 702 the lever 110 to the second position 700. This causes, due to the coupling of the cog insert 604, the first crushing plate 601 and the second crushing plate 602 to come together, thereby crushing the pill, tablet, or other object. Upon returning the lever 110 to the first position 600, the pouch or crushed matter can be removed from the crushing device 100. As noted above, one or more springs 613, 614 can be incorporated into the crushing assembly 102 to apply a preloading force against the first crushing plate 601 and the second crushing plate 602, respectively. This preloading force can then bias the first crushing plate 601 and the second crushing plate 602 toward the first position 600. Thus, when the lever 110 is in the second position 700, the preloading force works to provide a "spring assist" to automatically return the lever 110 to the first position 600 in one or more embodiments.

As shown in FIGS. 1-7, embodiments of the disclosure provide a crushing device 100 comprising a base 101 and a first sidewall 103 and second sidewall 104, each of which extends distally from the base 101. A first fastener, which is a first cylindrical fastener 405 in this embodiment, defines a first axis 111 that is substantially orthogonal to the first sidewall 103 and the second sidewall 104. Similarly, a second fastener, which is a second cylindrical fastener 506 in this embodiment, defines a second axis 112 that is substantially orthogonal to the first sidewall 103 and the second sidewall 104 in this embodiment. A first crushing plate 601 is pivotally coupled about the first fastener, while a second crushing plate 602 is pivotally coupled about the second fastener.

A cog insert 604 is coupled between the first crushing plate 601 and the second crushing plate 602. In one or more embodiments, the cog insert 604 is operable to cause the second crushing plate 602 to pivot about the second fastener in a direction 704 that is opposite a direction 703 the first crushing plate 601 pivots about the first fastener when the first crushing plate 601 pivots about the first fastener.

A lever 110 is coupled to the first crushing plate 601. The lever 110 is selectively movable between a first position 600 and a second position 700. The second position 700 is angularly displaced 703 about the first axis 111 from the first position 600. When the lever 110 moves from the first position 600 to the second position 700, this rotates the first crushing plate 601 about the first fastener. The cog insert 604 rotates the second crushing plate 602 about the second fastener, thereby causing crushing faces of the first crushing plate 601 and the second crushing plate 602 to abut to crush a pill, tablet, or other object.

When the lever 110 is in the first position 600, the first crushing plate 601 and the second crushing plate 602 define a V-shape 608. However, when the lever 110 is in the second position 700, the first crushing plate 601 and the second crushing plate 602, and more particularly the front surface 611 of the first crushing plate 601 and the front surface 612 of the second crushing plate 602, abut.

Advantageously, embodiments of the disclosure provide a "single pivot" design i.e., the lever upon which force is applied to actuate the crushing assembly 102 pivots only about the first axis 111, to generate the requisite crushing pressure needed to crush pills, tablets, or other similar objects. Embodiments of the disclosure provide a crushing device 100 that can be used to crush individual pills. Alternatively, the crushing device 100 can be used with a pill-crushing pouch. Such a pill-crushing pouch can be manufactured from a first layer of material and a second layer of material. The material can be pellucid or translucent so that pills or tablets inserted therein can be readily seen. For example, the material can be clear polyethylene. Other flexible, sturdy materials with behavioral characteristics similar to polyethylene can also be used.

Figure 8:
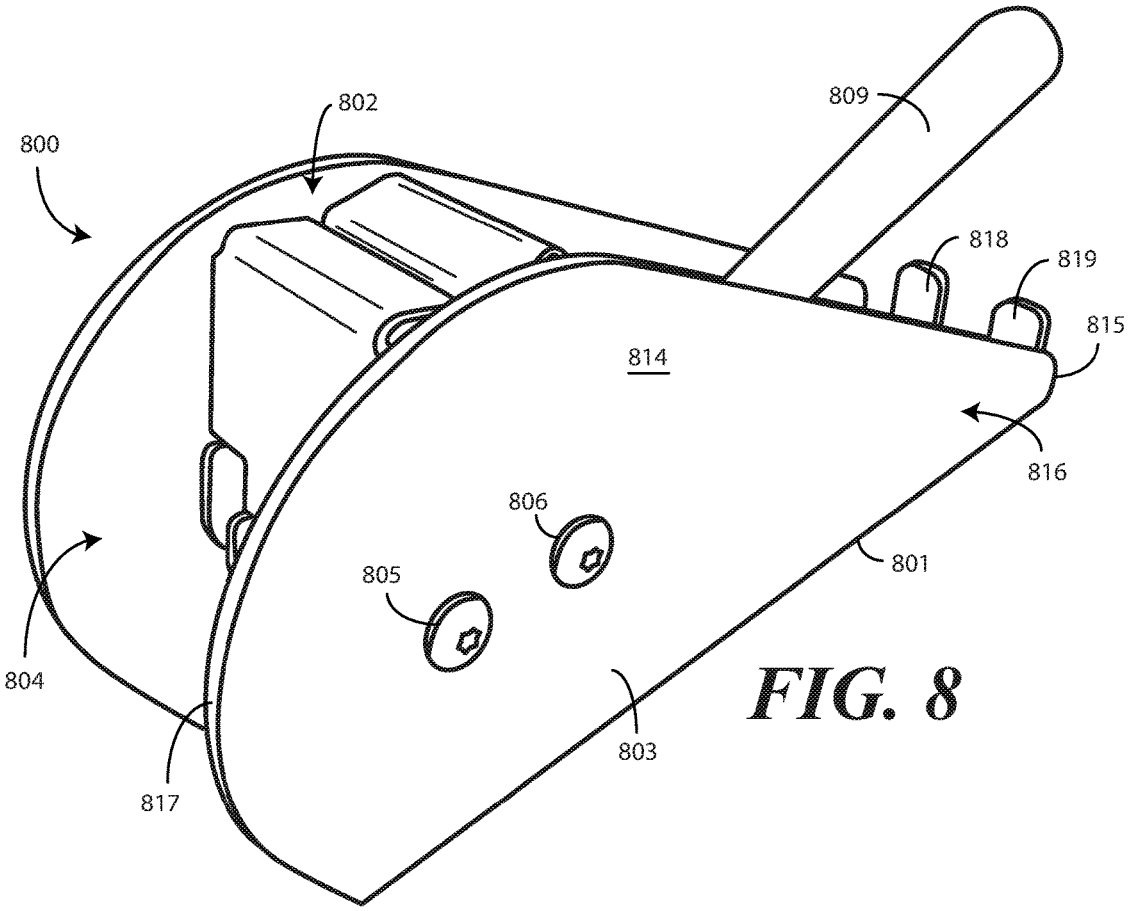
FIG. 8 illustrates a perspective view of another pill crusher in accordance with one or more embodiments of the disclosure.

Turning now to FIG. 8, illustrated therein is another crushing device 800 configured in accordance with one or more embodiments of the disclosure. As with the crushing device (100) of FIGS. 1-7, the crushing device 800 of FIG. 8 is suitable for crushing pills, tablets, and other similar objects. In one or more embodiments pills, tablets, or other small objects can be placed into a pouch that can be inserted into a crushing assembly 802 of the crushing device 800 for crushing. After crushing, the pills, tablets, or other small objects can be poured from the pouch for subsequent usage.

Advantageously, the crushing device 800 of FIG. 8 has a unique housing that defines a pouch receiver, as will be described below in more detail with reference to FIGS. 18-21. The pouch receiver allows spare pouches to be handily and tidily stored in the housing of the crushing device 800. In one or more embodiments, a follower is included to apply downward pressure upon the pouches so as to frictionally retain them within the pouch receiver. The follower, which may be operated by gravity or biased against the pouch by leaf springs, coil springs, or other springs, allows the crushing device 800 to be picked up, carried, moved, or otherwise lifted while still retaining the pouches within the pouch receiver.

As before, the crushing device 800 consists generally of a base 801 and a crushing assembly 802. A first sidewall 803 and a second sidewall 804 extend distally from the base 801. In this embodiment, the first sidewall 803 and the second sidewall 804 extend distally substantially orthogonally from the base 801 such that the first sidewall 803 and the second sidewall 804 are substantially parallel.

In this illustrative embodiment, the first sidewall 803 and the second sidewall 804 are half-heart shaped, with a cusp 815 of the half-heart shape 816 disposed at a rear end of the crushing device 800 and a major arc 817 of the half-heart shape 816 disposed at a front end of the crushing device 800. As will be described in more detail below with reference to FIGS. 18-21, making the first sidewall 803 and the second sidewall 804 half-heart shaped has numerous advantages. First, it provides a stylish aesthetic that is visually attractive. Second, the tapering nature of the half-heart shape 816 from the major arc 817 to the cusp 815 allows the handle 809 to move downward to close the crushing assembly 802 without either the first sidewall 803 or the second sidewall 804 contacting the user's knuckles or hand. Next, the tapering portion of the half-heart shape 816 between the major arc 817 and the cusp 815, along with two L-shaped feet 818, 819 advantageously defines a pouch receiver as will be described in more detail below.

Thus, in one or more embodiments the first sidewall 803 and the second sidewall 804 each define predominantly half-heart shaped major faces 814, in that each defines half of a traditional scalloped shape heart with a dent in its base that is commonly used on St. Valentine's Day cards, candy boxes, and other popular cultural artifacts. However, it should be noted that other shapes for the major faces 814 of the first sidewall 803 and second sidewall 804 can be used as well, as noted above.

Figure 9:
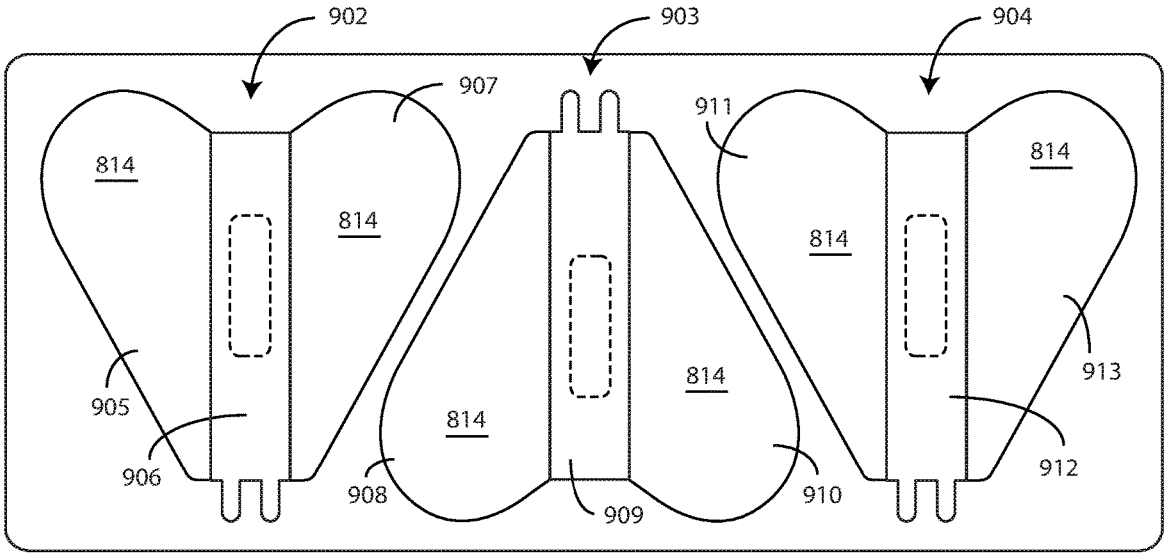
FIG. 9 illustrates one explanatory blank from which a body of a pill crusher can be cut in accordance with one or more embodiments of the disclosure.

Turning briefly to FIG. 9, another advantage of using heart-shaped major faces 814 can be seen. In this figure, a slab 901 of metal is shown as a blank from which housings for one or more crushing devices configured in accordance with one or more embodiments of the disclosure can be cut. In this blank, three housings 902, 903, 904 are illustrated with die lines showing where cutting operations can occur.

In this illustrative example, housing 902 includes a first sidewall 905, a second sidewall 907, and a base 906. The base 906 couples the first sidewall 905 to the second sidewall 907.

Similarly, housing 903 includes a first sidewall 910, a second sidewall 908, and a base 909. The base 909 couples the first sidewall 910 to the second sidewall 908. Housing 904 includes a first sidewall 911, a second sidewall 913, and a base 912. The base 912 couples the first sidewall 911 to the second sidewall 913.

Due to the tapering nature of the half-heart shaped sidewalls 814, housing 902 and housing 904 each taper downward. This allows housing 903 to be inverted by 180 degrees, thereby nesting between housing 902 and housing 904. Housing 903 therefore tapers upward due to its inversion. By inverting every other housing by 180 degrees, material can be saved and more housings can be cut from each blank. This is just another example of how the use of half-heart shaped sidewalls 814 are advantageous when used in crushing devices configured in accordance with one or more embodiments of the disclosure.

Referring now back to FIG. 8, in one or more embodiments the first sidewall 803, the second sidewall 804, and the crushing assembly 802 are manufactured from a rigid metal such as steel or aluminum. In one or more embodiments, this steel is painted a predefined color to indicate that the object is in fact a crushing device 800. In one or more embodiments, the color is blue. Other colors will be obvious to those of ordinary skill in the art having the benefit of this disclosure.

In other embodiments, the first sidewall 803, the second sidewall 804, and the crushing assembly 802 can be manufactured from rigid thermoplastics such as ABS, polycarbonate, or ABS-polycarbonate. Additionally, some various portions of the crushing device 800 can be manufactured from different materials. For example, the first sidewall 803 and the second sidewall 804, and perhaps the handle 809, might be manufactured from a thermoplastic material, while the crushing assembly 802 is manufactured from metal or an alloy. Other materials from which some or all of the components of the crushing device can be manufactured will be obvious to those of ordinary skill in the art having the benefit of this disclosure.

Figure 11:
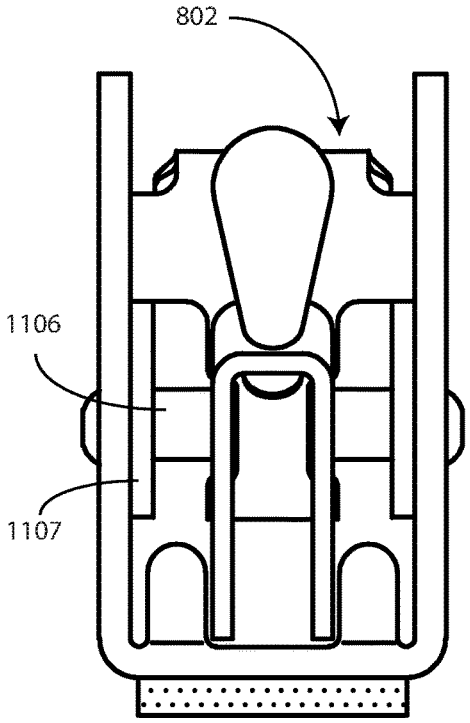
FIG. 11 illustrates a rear elevation view of a pill crusher in accordance with one or more embodiments of the disclosure.
Figure 12:
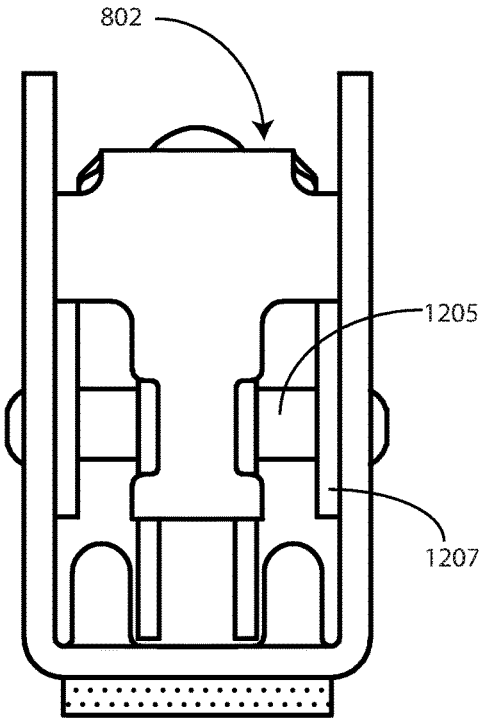
FIG. 12 illustrates a front elevation view of one explanatory pill crusher in accordance with one or more embodiments of the disclosure.

In one embodiment, the crushing assembly 802 is coupled between the first sidewall 803 and the second sidewall 804 by one or more fasteners 805, 806. In this illustrative embodiment, the crushing assembly 802 is coupled between the first sidewall 803 and the second sidewall 804 by two cylindrical fasteners. Turning briefly to FIGS. 11 and 12, the cylindrical fasteners, i.e., a first cylindrical fastener 1205 and a second cylindrical fastener 1106, are shown. Various devices can be employed as the first cylindrical fastener 1205 and the second cylindrical fastener 1206, including bolts, screws, compression bolts, rivets, or other coupling devices. Still other fasteners will be obvious to those of ordinary skill in the art having the benefit of this disclosure.

In one or more embodiments, each of the first cylindrical fastener 1205 and the second cylindrical fastener 1106 defines a pivot 1207, 1107 for the components of the crushing assembly 802. Illustrating by example, turning briefly to FIG. 14, in this embodiment the crushing assembly 802 includes both a first crushing plate 1401 and a second crushing plate 1402. The first crushing plate 1401 is pivotally coupled about the first pivot (1207). Similarly, the second crushing plate 1402 is pivotally coupled about the second pivot 1107 in this embodiment.

Moreover, in one or more embodiments each of the first cylindrical fastener 405 and the second cylindrical fastener 506 defines an axis 1411, 1412 about which these components of the crushing assembly 802 may rotate. Thus, in this embodiment the first crushing plate 1401 pivots about the first axis 1411, while the second crushing plate 1402 pivots about the second axis 1412. In one or more embodiments the first axis 1411 and the second axis 1412, defined by the first fastener 805 and the second fastener 806, respectively, are substantially parallel.

Figure 10:
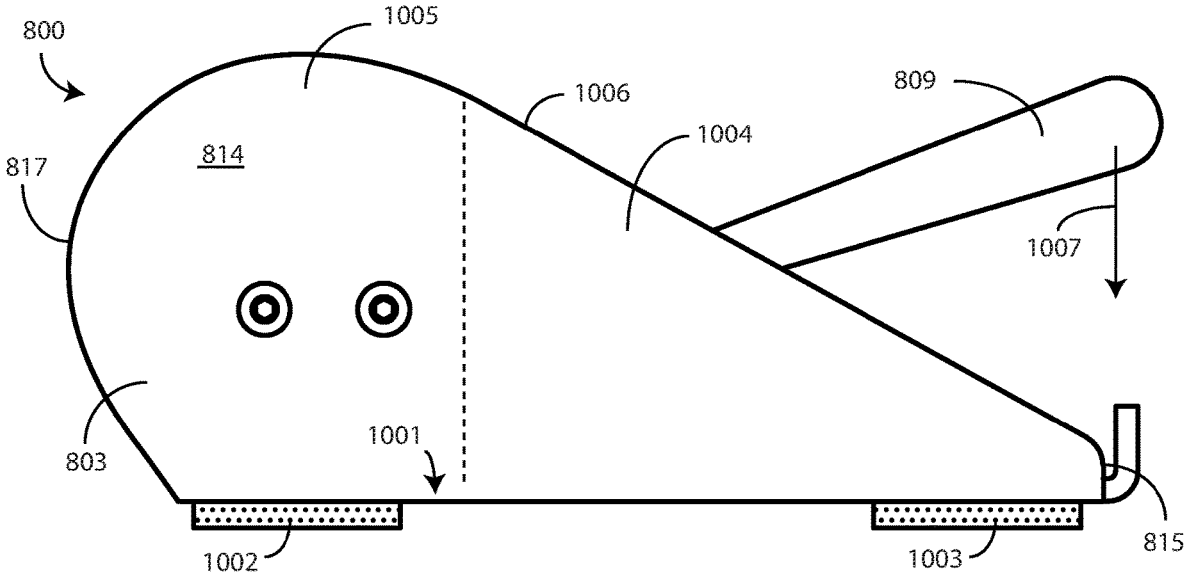
FIG. 10 illustrates a side elevation view of a pill crusher in accordance with one or more embodiments of the disclosure.

Turning now to FIG. 10, when viewed in this side elevation view, each of the first sidewall 803 and the second sidewall (804) extend upwardly from the base 801. In this illustrative embodiment, each of the first sidewall 803 and the second sidewall (804) shares a contiguous border 1001 with the base 801. In one or more embodiments, one or more rubber pads 1002, 1003 can be attached to the base 801 to provide mechanical support for the crushing assembly (802) when in operation.

In one or more embodiments, the half-heart shaped major face 814 can be considered to be the union of two components: the partial cone shaped portion 1004 and the partial curved portion 1005. The partial cone shaped portion 1004 extends from the major arc 817 toward the cusp 815, while the partial curved portion 1005 includes the major arc 817 only and does not include the straight side 1006 of the partial cone shaped portion 1004.

In this illustrative embodiment, the partial cone shaped portion 1004 extends distally from the partial curved portion 1005 beneath the handle 809. As previously described, the handle 809 that is coupled to the lever that actuates the crushing assembly (802). In other embodiments, the partial curved portion 1005 can be bounded on both sides by partial cone shaped portions. For example, a mirror image of partial cone shaped portion 1004 could extend from the left side of the partial curved portion 1005 in another embodiment.

When using the crushing device 800, a user translates 1007 the handle 809 and its attached lever toward the base of the partial cone shaped portion 1004, i.e., toward the cusp 815 of the half-heart shaped major face 814, from a first position to second position. By having the partial cone shaped portion 1004 disposed beneath the handle 809, its base provides a mechanical structure that opposes the translation 1007 of the handle 809 and attached lever to keep the crushing device 800 upright on a flat surface.

Figure 15:
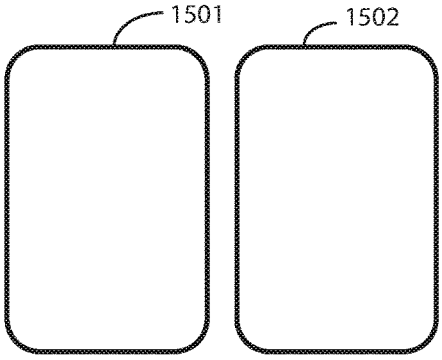
FIG. 15 illustrates one example of crushing faces suitable for use with one or more pill crushers configured in accordance with one or more embodiments of the disclosure.
Figure 16:
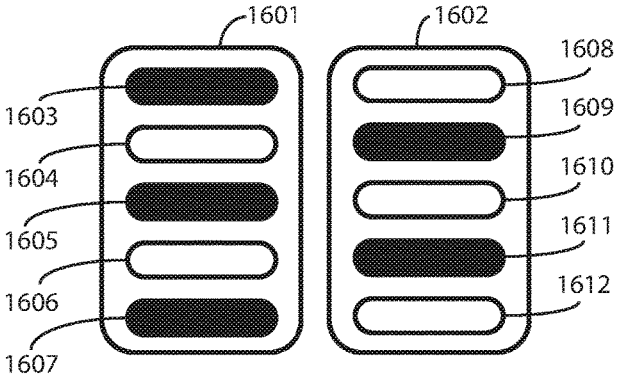
FIG. 16 illustrates another example of crushing faces suitable for use with one or more pill crushers configured in accordance with one or more embodiments of the disclosure.
Figure 17:
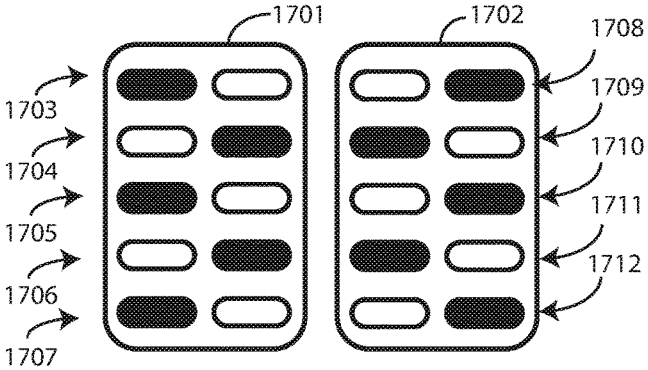
FIG. 17 illustrates yet another example of crushing faces suitable for use with one or more pill crushers configured in accordance with one or more embodiments of the disclosure.

As noted above, in one or more embodiments, the crushing assembly 802 comprises a first crushing plate 1401 and a second crushing plate 1402. Turning now to FIGS. 15-17, examples of such crushing plates are shown.

Beginning with FIG. 15, a first crushing plate 1501 and a second crushing plate 1502 are shown. In this illustrative embodiment, the crushing plates 1501, 1502 are flat, smooth, planar surfaces. Many applications will work well with smooth, flat crushing plates. While the first crushing plate 1501 and the second crushing plate 1502 are planar in FIG. 15, they could take other complementary shapes. For example first crushing plate 1501 could be convex, with second crushing plate 1502 having a complementary concave curvature. Similarly, first crushing plate 1501 could be S-shaped, with second crushing plate 1502 having a complementary S-shape, and so forth. Still other complementary shapes for the first crushing plate 1501 and the second crushing plate 1502 will be obvious to those of ordinary skill in the art having the benefit of this disclosure.

Turning to FIG. 16, illustrated therein are again a first crushing plate 1601 and a second crushing plate 1602. Rather than being smooth, in this embodiment the first crushing plate 1601 and the second crushing plate 1602 include surface features. In this illustrative embodiment, the first crushing platen 1602 includes one or more convex protrusions 1603, 1604, 1605, each of which extends out of the page as viewed in FIG. 16, and one or more concave recesses 1606, 1607, each of which extends into the page. Similarly, the second crushing plate 1602 includes one or more convex protrusions 1611, 1612 and one or more concave recesses 1608, 1609, 1610.

In this illustrative embodiment, each of the one or more convex protrusions 1603, 1604, 1605 and one or more concave recesses 1606, 1607 of the first crushing plate 1601, and the one or more convex protrusions 1611, 1612 and one or more concave recesses 1608, 1609, 1610 of the second crushing plate 1602, are linear, with each extending in a line horizontally across substantially the width of the first crushing plate 1601 and the second crushing plate 1602, respectively. However, in other embodiments each of the one or more convex protrusions 1603, 1604, 1605 and one or more concave recesses 1606, 1607 of the first crushing plate 1601, and the one or more convex protrusions 1611, 1612 and one or more concave recesses 1608, 1609, 1610 of the second crushing plate 1602, can take other shapes, including zigzags, S-shapes, and other shapes. Still other shapes for each of the one or more convex protrusions 1603, 1604, 1605 and one or more concave recesses 1606, 1607 of the first crushing plate 1601, and the one or more convex protrusions 1611, 1612 and one or more concave recesses 1608, 1609, 1610 of the second crushing plate 1602, will be obvious to those of ordinary skill in the art having the benefit of this disclosure.

In this embodiment, the one or more convex protrusions 1603, 1604, 1605 of the first crushing plate 1601 are complementary to the one or more concave recesses 1608, 1609, 1610 of the second crushing plate 1602. Similarly, the one or more concave recesses 1606, 1607 of the first crushing plate 1601 are complementary to the one or more convex protrusions 1611, 1612 of the second crushing plate 1602. Thus, when the first crushing plate 1601 and the second crushing plate 1602 abut, the one or more convex protrusions 1603, 1604, 1605 of the first crushing plate 1601 engage, and seat within, the one or more concave recesses 1608, 1609, 1610 of the second crushing plate 1602. Similarly, the one or more concave recesses 1606, 1607 of the first crushing plate 1601 engage, and seat within, the one or more convex protrusions 1611, 1612 of the second crushing plate 1602.

Turning now to FIG. 17, illustrated therein are two additional crushing plates, i.e., a first crushing plate 1701 and a second crushing plate 1702. In this illustrative embodiment, rather than extending substantially across the width of each crushing plate, rows 1703, 1704, 1705, 1706, 1707 of protrusion/recess pairs are disposed along the first crushing plate 1701, while complementary rows 1708, 1709, 1710, 1711, 1712 of protrusion/recess pairs are disposed along the second crushing plate 1702.

In this illustrative embodiment, alternating rows include alternating protrusion/recess pairs. For example, every other row 1703, 1705, 1707 of the first crushing plate 1701 includes a protrusion-recess pair (viewed left to right), while interspaced rows 1704, 1706 each include a recess-protrusion pair. Similarly, every other row 1708, 1710, 1712 of the second crushing plate includes a recess-protrusion pair that is complementary to the protrusion recess pairs of every other row 1703, 1705, 1707 of the first crushing plate 1701. Similarly, the interspaced rows 1709, 1711 of the second crushing plate 1702 include protrusion-recess pairs that are complementary to the recess-protrusion pairs of the interspaced rows 1704, 1706 of the interspaced rows of the first crushing plate. This subdivision of the rows 1703, 1704, 1705, 1706, 1707 of protrusion/recess pairs disposed along the first crushing plate 1701 and complementary rows 1708, 1709, 1710, 1711, 1712 of protrusion/recess pairs disposed along the second crushing plate 1702 works to increase the surface area to further crush objects disposed between the first crushing plate 1701 and the second crushing plate 1702. While each row here includes a single protrusion-recess pair, in other embodiments two or more protrusion-recess pairs could be disposed along the rows as well. Other configurations for the placement of protrusions and recesses along crushing plates will be obvious to those of ordinary skill in the art having the benefit of this disclosure.

Figure 13:
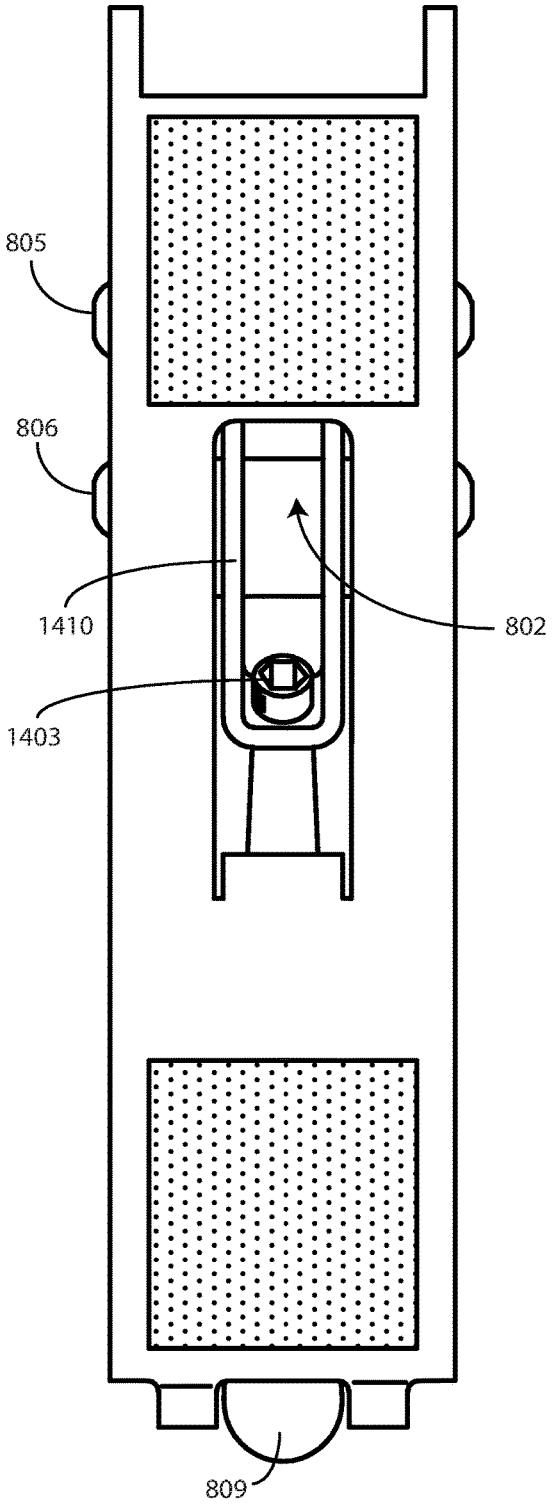
FIG. 13 illustrates a bottom plan view of a pill crusher in accordance with one or more embodiments of the disclosure.
Figure 14:
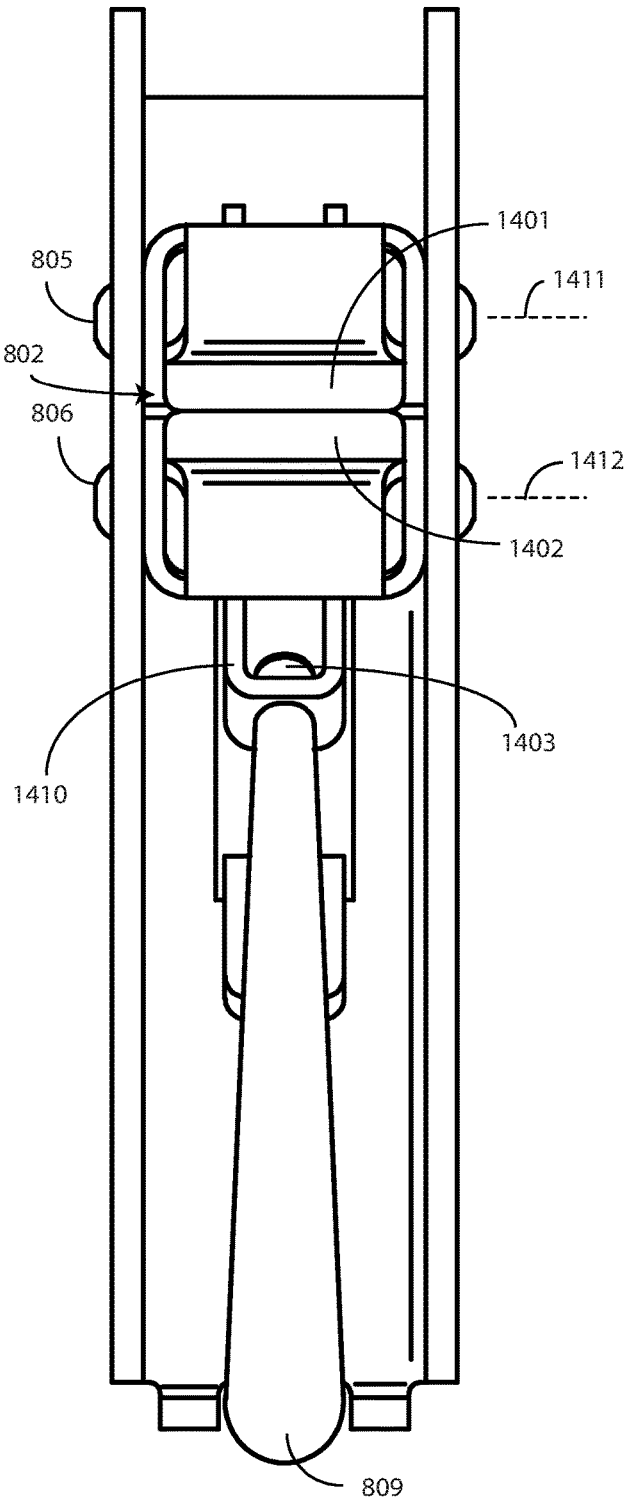
FIG. 14 illustrates a top plan view of one explanatory pill crusher in accordance with one or more embodiments of the disclosure.

Turning now back to FIGS. 13-14, as before a lever 1410 is mechanically coupled to the first crushing plate 1401 in this illustrative embodiment. The lever 1410 can be coupled to the handle 809. In one embodiment the lever 1410 and first crushing plate 1401 are manufactured from a contiguous piece of metal, such as steel or aluminum, while the handle 809 is manufactured from a different material, such as rubber, plastic, or resin. The handle 809, in this illustrative embodiment, is coupled to the lever 1410 by a nut 1403. However, the handle 809 can be adhesively coupled to the lever 1410, or alternatively coupled to the lever 1410 by screws or other fasteners. By manufacturing the handle 809 from a material that is different from that from which the lever 1410 is manufactured, a user has a more comfortable surface upon which to apply pressure. Additionally, the handle 809 can be a different color from the other components. For example, the body can be blue while the handle 809 is white, and so forth. This is in addition to the fact that the handle 809 can be manufactured with a pleasing texture as well.

Figure 18:
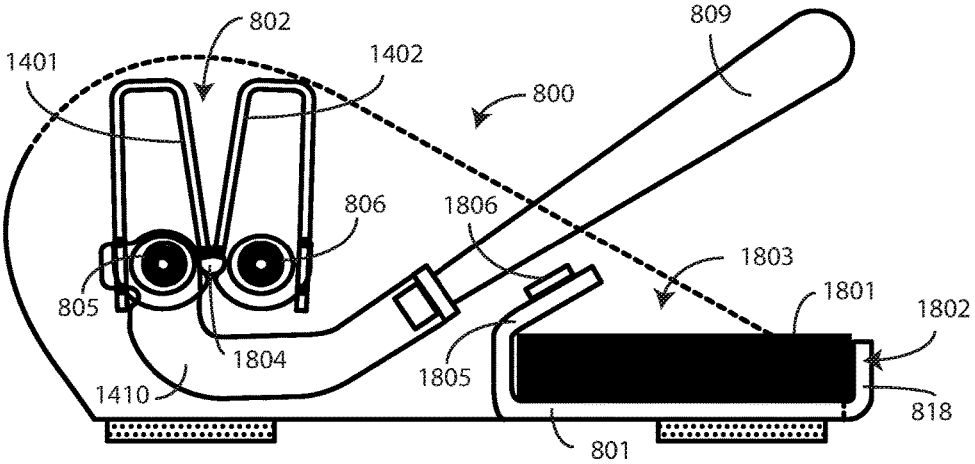
FIG. 18 illustrates a side elevation view of a pill crusher, with a sidewall shown in a transparent state to allow the internal components of the pill crusher to be seen, including a storage compartment for one or more pill crushing bags in accordance with one or more embodiments of the disclosure.

In one embodiment, the lever 1410 defines a J-shaped interconnection between the handle 809 and the first crushing plate 1401. As best seen in FIG. 18, in one embodiment the second crushing plate 1402 is disposed between the handle 809 and the first crushing plate 1401 when the lever 1410 is in the default position. This occurs because the J-shaped interconnection passes from the handle 809 around the second crushing plate 1402 and to the first crushing plate 1401 in this embodiment.

In this illustrative embodiment, the first crushing plate 1401 and the second crushing plate 1402 each comprise the same three surfaces as were previously described with reference to FIG. 6 above, namely, a rear surface, an upper surface, and a front surface. As before, the second crushing plate 1402 of this illustrative embodiment is essentially a mirror image of the first crushing plate 1401. In this embodiment, the upper surface extends distally from an end of the rear surface at a substantially orthogonal angle. The front surface then extends from an end of the upper surface at an obtuse angle to define a V-shape with the front surface of the second crushing plate 1402.

The first crushing plate 1401 is pivotally coupled about the first cylindrical fastener 805 in this embodiment. Similarly, the second crushing plate 1402 is pivotally coupled about the second cylindrical fastener 806. As before, the lever 1410 is selectively movable between a first position, which is shown in FIG. 18, and a second position, analogous to the second position (700) shown in FIG. 7. The first position is angularly displaced about the first axis defined by the first cylindrical fastener from the first position. In one or more embodiments, this angular displacement is about thirteen degrees. This minor displacement is in contrast to the extremely large displacement found in prior art crushing devices, which is on the order of fifty degrees. Thus, when a user rotates the lever 1410 about the first cylindrical fastener 805 in a first direction, which is the clockwise direction as the crushing device 800 is viewed in FIG. 18, the lever 1410 is angularly displaced relative to the first position.

A cog insert 1804 couples the first crushing plate 1401 and the second crushing plate 1402 as before. Each of the first crushing plate 1401 and the second crushing plate 1402 includes a concave recess at its nadir. The cog insert 1804, which can be manufactured from a cylindrical metal or plastic rod, can then be disposed in both the first concave recess and the second concave recess as previously described. The cog insert 1804 thus is coupled between the first crushing plate 1401 and the second crushing plate 1402.

When the lever 1410 translates or rotates from the first position to the second position, this causes the first crushing plate 1401 to pivot about the first cylindrical fastener 805 and the first axis (1411) in a first radial direction. When this occurs, the cog insert 1804, coupled between the first crushing plate 1401 and the second crushing plate 1402, causes the second crushing plate 1402 to rotate about the second cylindrical fastener 806 and the second axis (1412) in a second radial direction opposite the second radial direction. This rotation in opposite directions of the first crushing plate 1401 and the second crushing plate 1402 causes the first crushing plate 1401 and the second crushing plate 1402 to abut when in the second position. By contrast, when the lever 1410 is in the first position, the first crushing plate 1401 and the second crushing plate 1402 define the V-shape shown in FIG. 18. Optional springs can be incorporated into the crushing assembly 802 to bias the first crushing plate 1401 and the second crushing plate 1402 to the first position 600.

In one or more embodiments, an optional mechanical stop 1805 can be included. In this illustrative embodiment, the mechanical stop 1805 comprises a section of the base 801 that has been folded backward and upward to define the mechanical stop 1805. In this illustrative embodiment, a compressible rubber pad 1806 is coupled to the mechanical stop 1805 to provide a soft landing surface for the handle 1809 when transitioning from the first position to the second position.

When using the crushing device 800, one may place a pill, tablet, or other article into a pouch 1801, a stack 1802 of which are shown disposed in a pouch receiver 1803 defined within the crushing device 800. In this illustrative embodiment, the pouch receiver 1803 is defined between the mechanical stop 1805, the base 801 of the crushing device 800, and the two L-shaped feet 818, (819) extending from the rear of the crushing device 800. The inclusion of a pouch receiver 1803 within the crushing device 800 advantageously allows for convenient storage of pouches when performing multiple crushing operations.

In one or more embodiments, a pouch 1801 can be drawn from the stack 1802. A pill, tablet, or other article can be inserted into the pouch 1801. The pouch 1801 can then be placed between the first crushing plate 1401 and the second crushing plate 1402 when the lever 1410 is in the first position. One then rotates the lever 1410 to the second position. This causes, due to the coupling of the cog insert 1804, the first crushing plate 1401 and the second crushing plate 1402 to come together, thereby crushing the pill, tablet, or other object disposed within the pouch 1801.

Upon returning the lever 1410 to the first position, the pouch 1801 and its stored crushed matter can be removed from the crushing device 800. As noted above, one or more springs can be incorporated into the crushing assembly 802 to apply a preloading force against the first crushing plate 1401 and the second crushing plate 1402, respectively. This preloading force can then bias the first crushing plate 1401 and the second crushing plate 1402 toward the first position 800. Thus, when the lever 1410 is in the second position, the preloading force works to provide a "spring assist" to automatically return the lever 1410 to the first position in one or more embodiments.

Embodiments of the disclosure contemplate that while the pouch receiver 1803 of FIG. 18 works well in practice, it is often the case that a user will want to move the crushing device 800 between locations when performing crushing operations. For example, a nurse may want to move from room to room when crushing different patient pills. While the pouch receiver 1803 works well to retain the pouches 1801 therein when the crushing device 800 is vertical, a user may turn the crushing device 800 sideways, upside down, or otherwise, when carrying the same. When this occurs, a pouch 1801 may slip out.

Figure 19:
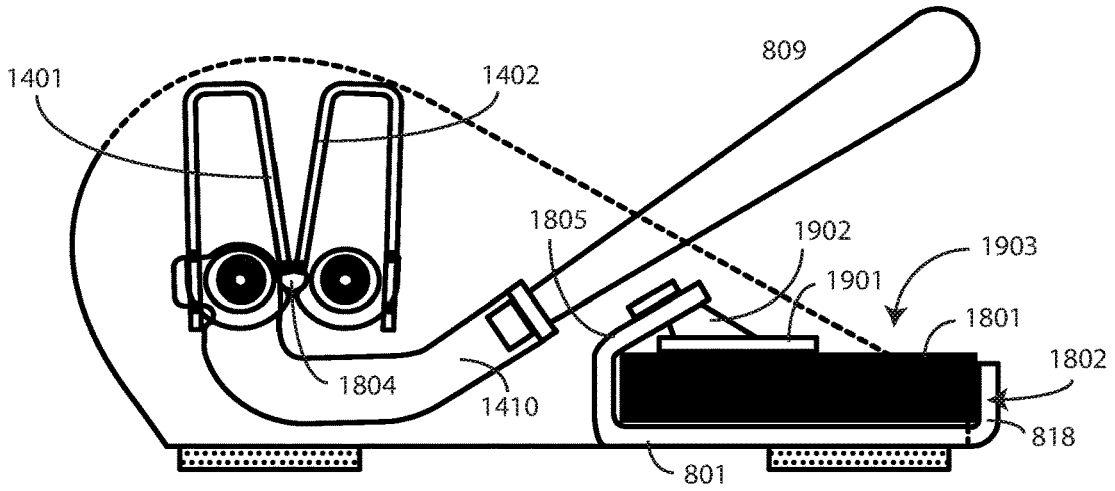
FIG. 19 illustrates a side elevation view of another pill crusher, with a sidewall shown in a transparent state to allow the internal components of the pill crusher to be seen, including a storage compartment for one or more pill crushing bags in accordance with one or more embodiments of the disclosure.

Turning to FIG. 19, illustrated therein is one solution to this situation. In FIG. 19, the crushing device 1900 once again includes a pouch receiver 1903. In this illustrative embodiment, the pouch receiver 1903 is defined between the mechanical stop 1805, the base 801 of the crushing device 1900, and the two L-shaped feet 818, (819) extending from the rear of the crushing device 1900.

In this illustrative embodiment, the pouch receiver 1903 includes a follower 1901 that is operable to frictionally retain the stack 1802 of pouches 1801 in the pouch receiver 1903 by biasing the stack 1802 against the base 801 of the crushing device 1900. In this illustrative embodiment, a spring 1902 applies a pre-loading force toward the base 801 of the crushing device 1900 to assist in frictionally retaining the stack 1802 of pouches 1801 within the pouch receiver 1903.

In this illustrative embodiment, the spring 1902 is coupled between the follower 1901 and the mechanical stop 1805 to bias the follower 1901 away from the mechanical stop 1805. The spring 1902 could take many forms. In one embodiment, the spring 1902 comprises a coiled spring that biases the follower 1901 away from the mechanical stop 1805 and toward the base 801 of the crushing device 1900. In another embodiment, the spring 1902 comprises one or more leaf springs that bias the follower 1901 away from the mechanical stop 1805 and toward the base 801 of the crushing device 1900. Other examples of devices that bias the follower 1901 away from the mechanical stop 1805 and toward the base 801 of the crushing device 1900 will be obvious to those of ordinary skill in the art having the benefit of this disclosure.

In one or more embodiments, a pouch 1801 can be drawn from the stack 1802. A pill, tablet, or other article can be inserted into the pouch 1801. The pouch 1801 can then be placed between the first crushing plate 1401 and the second crushing plate 1402 when the lever 1410 is in the first position. One then rotates the lever 1410 to the second position. This causes, due to the coupling of the cog insert 1804, the first crushing plate 1401 and the second crushing plate 1402 to come together, thereby crushing the pill, tablet, or other object disposed within the pouch 1801.

Figure 20:
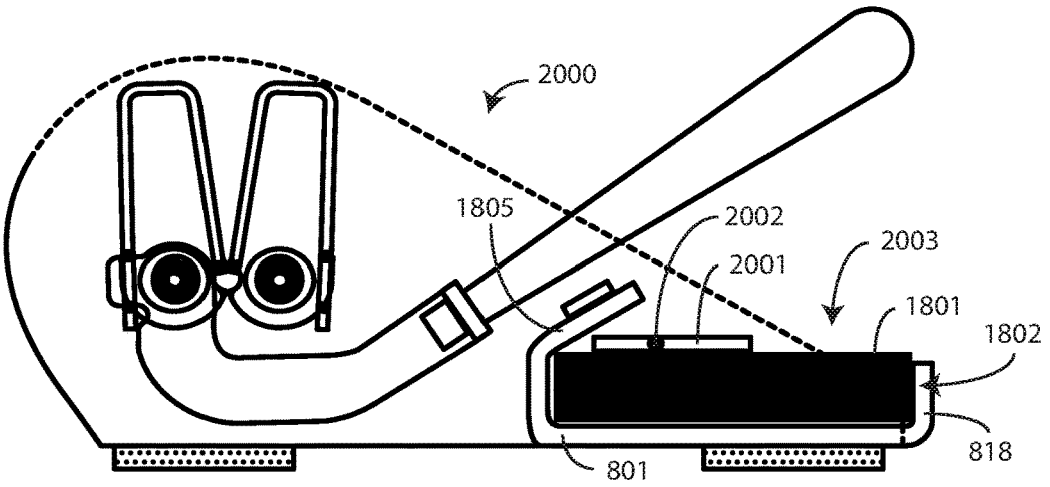
FIG. 20 illustrates a side elevation view of yet another pill crusher, with a sidewall shown in a transparent state to allow the internal components of the pill crusher to be seen, including a storage compartment for one or more pill crushing bags in accordance with one or more embodiments of the disclosure.
Figure 21:
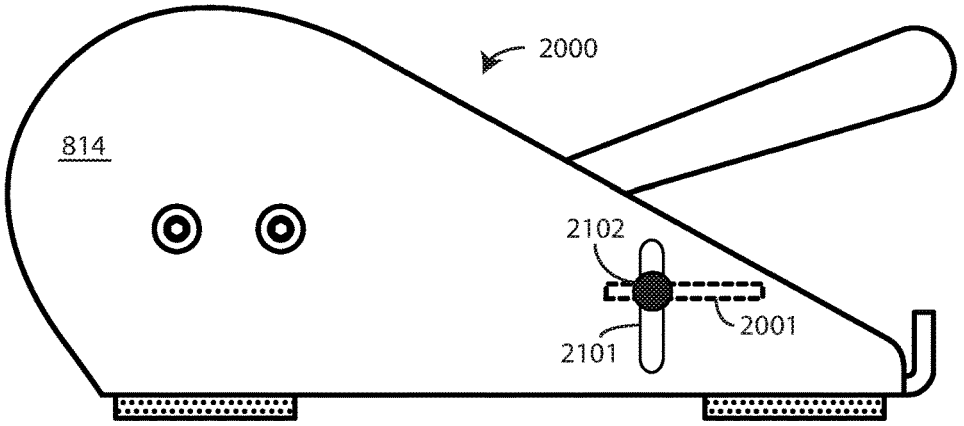
FIG. 21 illustrates another side elevation view of a pill crusher in accordance with one or more embodiments of the disclosure.

Turning to FIG. 20, illustrated therein is another solution to prevent pouches 1801 from inadvertently slipping from the pouch receiver 2003. In FIG. 20, the crushing device 2000 once again includes a pouch receiver 2003. In this illustrative embodiment, the pouch receiver 2003 is defined between the mechanical stop 1805, the base 801 of the crushing device 2000, and the two L-shaped feet 818, (819) extending from the rear of the crushing device 2000.

Once again, in this illustrative embodiment the pouch receiver 2003 includes a follower 2001 that is operable to frictionally retain the stack 1802 of pouches 1801 in the pouch receiver 2003 by biasing the stack 1802 against the base 801 of the crushing device 2000. In this illustrative embodiment, rather than including a spring (1902), the follower 2001 is manufactured from a heavy material, such as steel or another metal. Accordingly, when the crushing device 2000 is in the vertical position, gravity pulls the follower 2001 downward to apply a pre-loading force toward the base 801 of the crushing device 2000. This downward force assists in frictionally retaining the stack 1802 of pouches 1801 within the pouch receiver 2003.

In one or more embodiments, an optional pin 2002 can be included to allow the follower 2001 to travel along a track defined in one of the half-heart shaped major faces 814. For example, turning now to FIG. 21, the half-heart shaped major face 814 of the crushing device 2000 is shown with a track 2101. The pin (2002) passes through the track 2101, where it engages an optional handle 2102 in this embodiment. The inclusion of the track 2101 advantageously prevents the follower 2001 from becoming separated from the crushing device 2000. Additionally, the handle 2102 allows a user to lift the follower 2001 to insert new stacks of pouches. It should be noted that the track and follower system can be used either with the crushing device 2000 of FIG. 21, which uses gravity to retain pouches in the pouch receiver, or the crushing device (1900) of FIG. 19, which uses the spring (1902) to retain pouches in the pouch receiver.

In some embodiments, the track 2101 will not extend completely through the half-heart shaped major face 814. It will instead extend only into an interior side of the half-heart shaped major face 814. The handle 2102 will then be omitted. The user can simply reach into the pouch receiver and lift the follower 2001 manually in this configuration.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A crushing device, comprising:

a base;

a first sidewall and a second sidewall extending distally from the base; and a crushing assembly coupled between the first sidewall and the second sidewall, the crushing assembly comprising:

a first crushing plate pivotally coupled about a first pivot defining a first axis;

a lever coupled to the first crushing plate, the lever selectively movable between a first position and a second position angularly displaced about the first axis from the first position to rotate the first crushing plate in a first radial direction about the first axis;

a second crushing plate pivotally coupled about a second pivot defining a second axis; and a cog insert, coupled between the first crushing plate and the second crushing plate;

the cog insert causing the second crushing plate to rotate in a second radial direction, opposite the first radial direction, when the lever moves from the first position to the second position.

2. The crushing device of claim 1, the first crushing plate and the second crushing plate defining a V-shape when the lever is in the first position, where the cog insert is disposed at a nadir of the V-shape.

3. The crushing device of claim 1, the first crushing plate and the second crushing plate abutting when the lever is in the second position.

4. The crushing device of claim 1, the lever comprising a handle and a J-shaped interconnection disposed between the handle and the first crushing plate.

5. The crushing device of claim 1, the first axis and the second axis parallel.

6. The crushing device of claim 1, further comprising a pouch receiver.

7. The crushing device of claim 1, the first sidewall and the second sidewall disposed along a first portion of the base, the base further comprising a pouch receiver.

8. The crushing device of claim 1, the first crushing plate defining a first concave recess, the second crushing plate defining a second concave recess, the cog insert disposed in both the first concave recess and the second concave recess.

9. The crushing device of claim 8, the cog insert comprising a cylindrical rod.

10. A crushing device, comprising:

a base;

a first sidewall and a second sidewall extending distally from the base, the first sidewall, the second sidewall, and the base defining a pouch receiver;

a first fastener defining a first axis that is substantially orthogonal to the first sidewall and the second sidewall;

a second fastener defining a second axis that is substantially orthogonal to the first sidewall and the second sidewall and parallel to the first axis;

a first crushing plate pivotally coupled about the first fastener;

a second crushing plate pivotally coupled about the second fastener;

a cog insert coupled between the first crushing plate and the second crushing plate, the cog insert operable to cause the second crushing plate to pivot about the second fastener in a direction opposite the first crushing plate when the first crushing plate pivots about the first fastener; and a lever, coupled to the first crushing plate, and selectively movable between a first position and a second position angularly displaced about the first axis from the first position to rotate the first crushing plate about the first fastener.

* * * * *